US007481661B2

(12) United States Patent
Takahashi et al.

(10) Patent No.: US 7,481,661 B2
(45) Date of Patent: Jan. 27, 2009

(54) CONNECTOR

(75) Inventors: Toshiharu Takahashi, Shizuoka (JP); Kazuto Ohtaka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/798,540

(22) Filed: May 15, 2007

(65) Prior Publication Data

US 2007/0293071 A1 Dec. 20, 2007

(30) Foreign Application Priority Data

Jun. 20, 2006 (JP) ..... 2006-170135

(51) Int. Cl.
*H01R 13/62* (2006.01)

(52) U.S. Cl. ..... 439/157; 439/160; 439/372

(58) Field of Classification Search ..... 439/157, 439/152, 160, 372
See application file for complete search history.

(56) References Cited

U.S. PATENT DOCUMENTS

| | | | | |
|---|---|---|---|---|
| 5,476,390 | A | 12/1995 | Taguchi et al. | 439/157 |
| 6,065,982 | A | 5/2000 | Okabe | 439/157 |
| 6,099,330 | A | 8/2000 | Gundermann et al. | 439/157 |
| 6,183,277 | B1 | 2/2001 | Okabe et al. | 439/157 |
| 2001/0044228 | A1* | 11/2001 | Noro et al. | 439/157 |
| 2005/0148221 | A1* | 7/2005 | Miyamoto | 439/157 |
| 2006/0040535 | A1* | 2/2006 | Koshy et al. | 439/157 |
| 2006/0089031 | A1* | 4/2006 | Flowers et al. | 439/157 |
| 2007/0128900 | A1* | 6/2007 | Bauman et al. | 439/157 |

FOREIGN PATENT DOCUMENTS

| | | |
|---|---|---|
| EP | 1 808 937 | 7/2007 |
| JP | 2002-359028 | 12/2002 |

OTHER PUBLICATIONS

Search Report from the United Kingdom Intellectual Property Office mailed Aug. 31, 2007 (3 pages).

* cited by examiner

*Primary Examiner*—Hien Vu
(74) *Attorney, Agent, or Firm*—Kratz, Quintos & Hanson, LLP

(57) ABSTRACT

Providing a connector with a lever, which can be prevented from falling away from a connector housing when the lever is pushed in a direction of separating from a mating connector at a condition in the condition, in which the connector housing is disengaged from the mating connector, the connector includes a connector housing, a lever mounted rotatably on the connector housing and a limiter projection. The lever rotates along an arrow so as to move the connector close to a mating connector. The lever rotates along another arrow so as to move the connector apart from the mating connector. The limiter projection limits the lever to rotate along another arrow in a condition that the connector is disengaged from the mating connector.

7 Claims, 4 Drawing Sheets

CONNECTOR

The priority application Number Japan Patent Application 2006-170135 upon which this patent application is based is hereby incorporated by reference.

BACKGROUND OF THE INVENTION

1. Field of the Invention

This invention relates to a connector having a lever mounted rotatably on a connector housing to receive a terminal.

2. Description of the Related Art

A connector having a lever, that is a lever-type connector, is well-known (for example, refer Patent document 1).

The lever-type connector includes a connector housing receiving a terminal and a lever, which is mounted rotatably on the connector housing and engaging the connector with a mating connector by rotating about the connector housing.

A central portion in a lengthwise direction of the lever is mounted rotatably on the connector housing. The lever rotates about the connector housing so as to projecting one end of the lever toward an outside of the connector housing when disengaging with the mating connector and pile the one end of the lever on the connector housing when engaging with the mating connector.

The connector is provided on the connector housing with a limiter projection for limiting a rotating range of the lever. The limiter projection is arranged in the vicinity of the other end of the lever to limit rotation of the lever in a direction, in which the lever rotates further from a condition, in which the connector housing is disengaged from the mating connector, by abutting on the other end. Refer Patent document of Japan Published Patent 2002-359028.

SUMMARY OF THE INVENTION

Objects to be Solved

According to the aforesaid lever-type connector by prior art, the limiter projection is provided in the vicinity of the other end of the lever. Thereby, when the lever is pushed further by a small force in a direction of separating the lever apart from the mating connector in a condition, in which the connector housing is disengaged from the mating connector, the small force is enlarged to a large force by a leverage of the lever, and the other end of the lever pushes the limiter projection by the large force pushes. Therefore, in the lever-type connector by prior art, even if the small force pushes the lever further in the direction of separating the lever apart from the mating connector in the condition of disengaging with the mating connector, the other end of the lever moves over the limiter projection and the lever may rotate further from a position limited by the limiter projection in the direction of moving apart from the mating connector. When the lever rotates further from the position, the lever is removed from the connector housing.

According to the lever-type connector by prior art, even if the small force pushes the lever further in the direction of separating the lever apart from the mating connector in the condition in the condition, in which the connector housing is disengaged from the mating connector, the lever may be unexpectedly removed from the connector housing.

According to the above problem, an object of the present invention is to provide a connector with a lever, which can be prevented from falling away from a connector housing when the lever is pushed in a direction of separating from a mating connector at a condition in the condition, in which the connector housing is disengaged from the mating connector.

How to attain the object of the present invention

In order to overcome the above problems and attain the object of the present invention, a connector is characterized in that the connector includes a connector housing; a lever, mounted rotatably at a central portion thereof on the connector housing, rotating in one direction so as to engage the connector housing with a mating connector by moving the connector housing close to the mating connector, and rotating the other direction opposite to the one direction so as to disengage the connector housing from the mating connector by moving the connector housing apart from the mating connector in uncoupling with the mating connector; and a limiter for limiting the lever not to rotate further in the other direction from a condition, in which the connector housing is disengaged from the mating connector; and the limiter is formed to project from the lever toward the connector housing and located in a vicinity of a rotation center of the lever against the connector housing.

The connector is further characterized in that one end of the lever projects toward an outside of the connector housing when the lever rotates further toward the other direction from the condition, in which the connector housing is disengaged from the mating connector, and the limiter is exposed to the outside of the connector housing and arranged at a position nearer to the other end of the lever than the rotation center in the condition, in which the connector housing is disengaged from the mating connector.

The connector is further characterized in that the limiter is arranged at an outer edge of the lever exposed to the outside of the connector housing in the condition, in which the connector housing is disengaged from the mating connector.

The connector is further characterized in that the limiter is provided with a slant surface slant to an engaging direction of engaging the connector housing with the mating connector, so as to move close to the connector housing and abut on the connector housing for touching tightly the lever and the connector housing by rotating the lever further in the other direction from the condition, in which the connector housing is disengaged from the mating connector.

The connector is further characterized in that the connector housing includes a main body receiving a terminal and a hood for arranging the lever between the main body and the hood, and the limiter projects from the lever toward the outside of the connector housing, and the slant surface is slant to the engaging direction to direct gradually the outside of the connector housing in accordance with approaching the hood, so as to move close to the hood and abut on the hood by rotating the lever further in the other direction from the condition, in which the connector housing is disengaged from the mating connector.

The connector is further characterized in that the connector housing includes a main body receiving a terminal and piling the lever on an outer surface of the main body, and the limiter projects from the lever toward an inside of the connector housing, and the slant surface is slant to the engaging direction to direct gradually the inside of the connector housing in accordance with approaching the main body, so as to move close to the main body and abut on the main body by rotating the lever further in the other direction from the condition, in which the connector housing is disengaged from the mating connector.

According to the connector of the present invention, since the limiter for limiting the rotation of the lever is located in the vicinity of the rotation center of the lever, the limiter is located nearer to a position of operating the lever.

According to the connector of the present invention, the limiter is exposed to the outside of the connector housing and arranged at the position nearer to the other end of the lever than the rotation center in the condition, in which the connector housing is disengaged from the mating connector. Thereby, even if the lever rotates further in the other direction in the condition, in which the connector housing is disengaged from the mating connector, the limiter approaches the connector housing.

According to the connector of the present invention, since the limiter is arranged at the outer edge of the lever, a shape of the lever becomes simpler and a molding die for molding the lever will be simpler.

According to the connector of the present invention, since the limiter is provided with the slant surface for touching tightly the lever and the connector housing, even if the lever rotates further in the other direction from the condition, in which the connector housing is disengaged from the mating connector, the connector housing and the lever touch more tightly.

According to the connector of the present invention, even if the lever rotates further in the other direction from the condition, in which the connector housing is disengaged from the mating connector, the hood of the connector housing and the lever touch more tightly by the slant surface provided at the limiter.

According to the connector of the present invention, since the limiter projects from the lever toward the inside of the connector housing, and the slant surface is slant to direct gradually the inside of the connector housing in accordance with approaching the main body of the connector housing, even if the lever rotates further in the other direction from the condition, in which the connector housing is disengaged from the mating connector, the main body of the connector housing and the lever touch more tightly.

EFFECTS OF THE INVENTION

According to the connector of the present invention, since the limiter is located nearer to the position of pushing the lever, when the lever rotates further in the other direction from the condition, in which the connector housing is disengaged from the mating connector, a pushing force of the limiter pushing the connector housing becomes smaller than a force of that the limiter is located at the farthest position from the position, on which the limiter pushes the lever. Thereby, when the lever rotates further in the other direction in the condition, in which the connector housing is disengaged from the mating connector, it is prevented that the limiter does not abut on the connector housing. Therefore, even if the lever is pushed to the direction of separating from the mating connector in the condition, in which the connector housing is disengaged from the mating connector, it can be prevented that the lever falls away from the connector housing.

According to the connector of the present invention, even if the lever rotates further in the other direction in the condition, in which the connector housing is disengaged from the mating connector, the limiter approaches the connector housing. Thereby, even if the lever rotates further in the other direction in the condition, in which the connector housing is disengaged from the mating connector, the limiter securely abuts on the connector housing. Therefore, it can be securely prevented that the lever falls away from the connector housing.

According to the connector of the present invention, the molding die for molding the lever can be simpler, so that cost of the connector can be reduced.

According to the connector of the present invention, since the limiter is provided with the slant surface for touching tightly the lever and the connector housing, even if the lever rotates further in the other direction from the condition, in which the connector housing is disengaged from the mating connector, the connector housing and the lever touch more tightly. Even if the lever rotates further in the other direction from the condition, in which the connector housing is disengaged from the mating connector, it can be more securely prevented that the lever falls away from the connector housing.

According to the connector of the present invention, even if the lever rotates further in the other direction from the condition, in which the connector housing is disengaged from the mating connector, the hood of the connector housing and the lever touch more tightly by the slant surface provided at the limiter. Therefore, when the lever rotates further in the other direction from the condition, in which the connector housing is disengaged from the mating connector, it can be more securely prevented that the lever falls away from the connector housing.

According to the connector of the present invention, even if the lever rotates further in the other direction from the condition, in which the connector housing is disengaged from the mating connector, the hood of the connector housing and the lever touch more tightly by the slant surface provided at the limiter. Therefore, when the lever rotates further in the other direction from the condition, in which the connector housing is disengaged from the mating connector, it can be more securely prevented that the lever falls away from the connector housing.

The above and other objects and features of this invention will become more apparent from the following description taken in conjunction with the accompanying drawings.

DESCRIPTION OF THE PREFERRED EMBODIMENT

Figure 1:
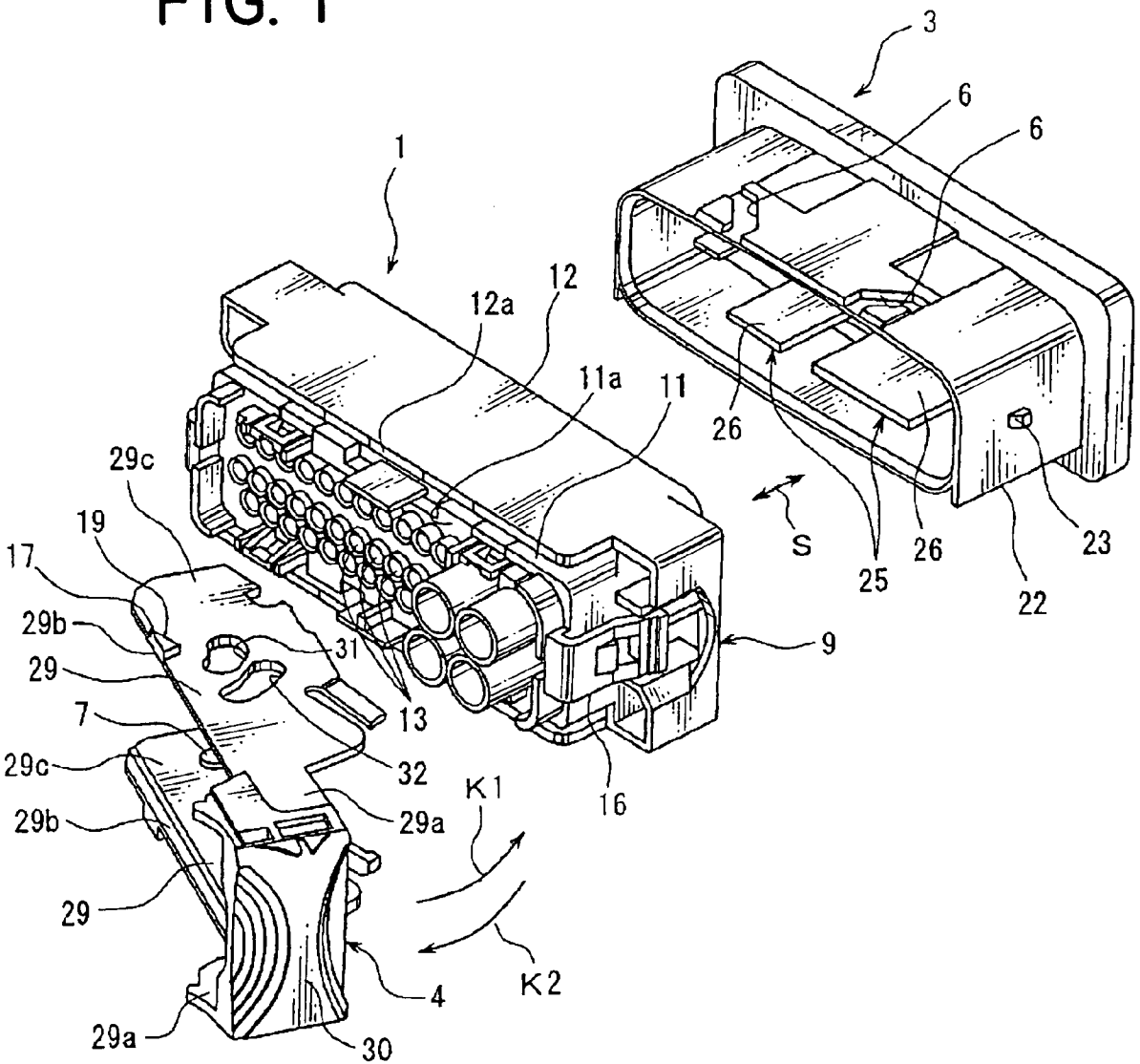
FIG. 1 is an exploded perspective view of a connector of an embodiment according to the present invention.

A first embodiment of a connector according to the present invention will be described as followings with reference to FIGS. 1-5. The connector 1 according to the first embodiment of the present invention engages with a mating connector 3 shown in FIG. 1.

The mating connector 3 includes a connector housing 22 and a pivot guide groove 6. The connector housing 22 formed into a tube-shape has a terminal receiving section for receiving a wire connecting portion of a male terminal 25 (shown in FIG. 1). The connector housing 22 is provided with a temporary engaging projection 23 and a lock projection. The temporary engaging projection 23 and the lock projection are formed by projecting from an outer surface of the connector housing 22. The temporary engaging projection 23 engages temporarily with a later-described lever lock arm 16 so as to fix temporarily the connectors 1 and 3. The lock projection engages with the lock arm so as to connect the connectors 1 and 3 to each other.

The pivot guide groove 6 is respectively provided on an outer surface of a pair of outer walls, which face to each other with a distance therebetween, of the connector housing of the mating connector 3. The pivot guide groove 6 is arranged at a position, in which a later-described lever support projection 14 positions between the connectors 1 and 3 when the connectors 1 and 3 are connected to each other. The pivot guide grooves 6 are respectively formed into a groove shape recessed from an outer surface of the connector housing 22.

One end of the pivot guide groove 6 has an opening at an edge, near to the connector 1, of the connector housing 22 of the mating connector 3. A pair of pivot guide grooves 6, between which the lever support projection 14 is positioned, tilts against a direction S as a later-described connecting direction so as to separate gradually to each other in accordance with positioning from the aforesaid edge to be apart from the connector 1. The pivot guide groove 6 has an opening at the other end of the pivot guide groove 6 toward the outside of the connector housing 22.

A pivot boss 7 penetrates through the opening at the other end into the pivot guide groove 6 structured as mentioned above. The pivot boss 7 in the pivot guide groove 6 can move freely in the pivot guide groove 6. When a lever 4 rotates as described later for connecting the connectors 1 and 3, the pivot boss 7 moves toward the aforesaid one end in the pivot guide groove 6. Since the pivot guide groove 6 tilts as mentioned above, by moving the pivot boss 7 from the other end to the one end, the connectors 1 and 3 are approached to each other.

The connector housing 22 of the mating connector 3 penetrates between later-described an inner housing 11 and an outer cover 12 of the connector 1, and the lever lock arm 16 engages temporarily with the temporary engaging projection 23 so that the mating connector 3 engages temporarily with the connector 1. An electric contact portion 26 of the male terminal 25 penetrates into a terminal receiving section 13 of the inner housing 11 of the connector 1, and the lock arm engages with the lock projection, so that the mating connector 3 is connected completely with the connector 1. Thereby, the mating connector 3 and the connector 1 connect electrically the male terminal 25 and a later-described female terminal so as to connect electrically electric wires joined with the male and female terminals. When the mating connector is connected with the connector 1, a part of the connector housing 22 penetrates between the inner housing 11 and a later-described flat portion 29 of the lever 4.

As shown in FIGS. 1-5, the connector 1 includes a connector housing 9, the lever 4, the pivot boss 7 (shown in FIG. 1), and a limiter projection 17 as a limiter.

The connector housing 9 includes a box-shape inner housing 11 as a main body, and a pipe shape outer cover 12 as a hood, in one piece as shown in FIG. 1. The inner housing 11 is formed into a box shape with a terminal receiving section 13 (shown in FIG. 3). The inner housing 11 receives a female terminal (not shown) in the each terminal receiving section 13.

Figure 3:
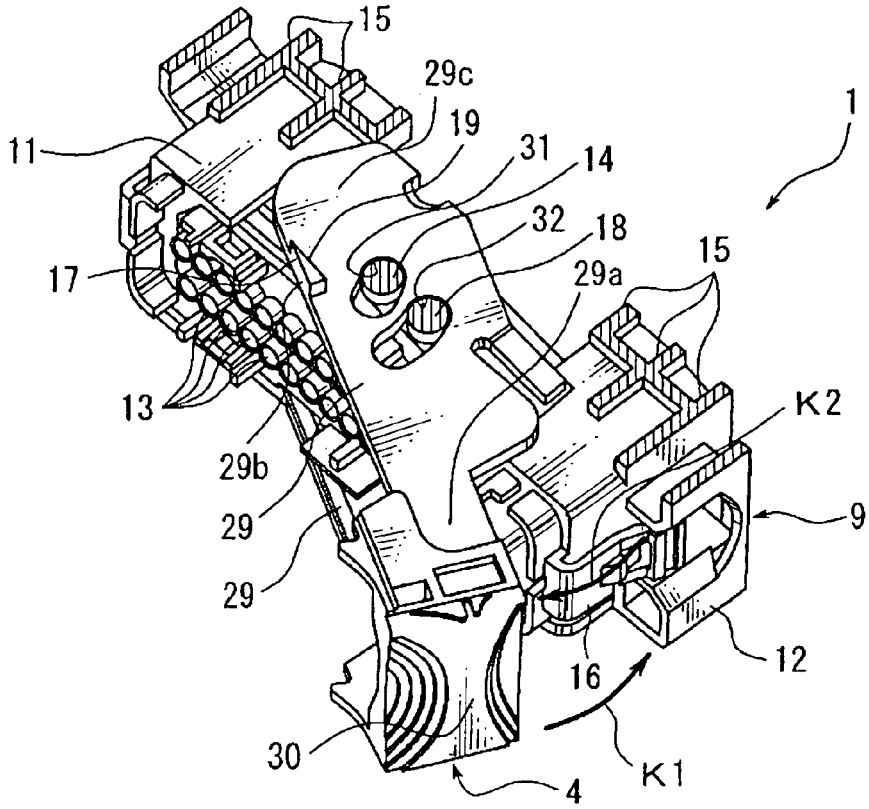
FIG. 3 is a perspective view of the connector, shown in FIG. 1, by removing a partial wall of an outer cover.

The outer cover 12 is formed together with the inner housing 11 so as to receive the inner housing 11 inside the outer cover 12. There is a space between an inner surface of the outer cover 12 and the outer surface of the inner housing 11. The outer cover 12 is provided on the inner surfaces thereof facing to each other with the lever support projection 14 and a guide projection 18, as shown in FIG. 3. The lever support projection 14 and the guide projection 18 are formed into a cylindrical shape. The lever support projection 14 and the guide projection 18 are arranged with a space to each other. The lever support projection 14 is located in the center of widthwise of the connector 1.

The widthwise is a direction perpendicular to a direction (shown with an S arrow in FIG. 1), in which the connectors 1, 3 move relatively (close to and apart from each other) when the connectors 1, 3 are engaged with or disengaged from each other as described later. The direction S, in which the connectors 1, 3 move close to and apart from each other, corresponds to a connecting direction of the connectors 1, 3 described in claims of the present invention. The connector housing 9 is provided with a plurality of connecting ribs 15 for connecting the inner housing 11 and the outer cover 12, as shown in FIG. 3.

On the outer surfaces (a pair of side surfaces located at a near side and a deep side in FIG. 1 in a width direction) of the inner housing 11 of the connector 1, lever lock arms 16 are provided. The lever lock arm 16 engages temporarily with the temporary engaging projection 23 when the connectors 1, 3 are engaged, and positions the lever 4 by engaging with a later-described operating plate 30 of the lever 4, which moves the connectors 1, 3 close to each other.

The connector housing 11 of the connector 1 is provided with a lock arm to be engaged with a lock projection of the connector housing 22 of the mating connector 3. By engaging the lever lock arm 16 temporarily with the temporary engaging projection 23, in a condition that the inner housing 11 penetrates into the mating connector 3 and the terminals spaces to each other, the connector 1 is locked temporarily in the mating connector 3, and by engaging the lock arm with the lock projection, the connector 1 engages with the mating connector 3.

The lever 4 has a pair of plate portions 29 and an operating plate 30 connecting both one ends 29*a* of the pair of plate portions 29 so as to be formed into a U-shape in a side view. The each plate portion 29 is formed into a band-plate-shape. The pair of plate portions 29 is arranged with a space in parallel to each other.

The one end 29*a* of the plate portion 29 corresponds to one end of the lever 4 described in claims of the present invention. The pair of plate portions 29 is provided respectively with a operating point guide hole 31 and a guide hole 32. The operating point guide hole 31 and the guide hole 32 pass through the plate portion 29.

The operating point guide hole 31 is located in the center both of lengthwise direction and widthwise direction of the plate portion 29. A shape in a plan view of the operating point guide hole 31 is an oval shape (also called as an elliptical shape), a long axis of which is aligned along the lengthwise direction of the plate portion 29. The lever support projection 14 penetrates into the operating point guide hole 31. The lever support projection 14 penetrating in the operating point guide hole 31 can move and rotate freely in the operating point guide hole 31. By inserting the lever support projection 14 into the operating point guide hole 31, the lever 4 is mounted rotatably around the center of the plate portion 29 on the connector 1.

The guide hole 32 is formed into an arced oval shape in a plan view. The guide hole 32 is spaced with the operating point guide hole 31. The guide hole 32 is arced so as to locate a center of curvature at a near side of the operating point guide hole 31. A guide projection 18 penetrates into the guide hole 32. The guide projection 18 penetrating in the guide hole 32 can move freely in the guide hole 32. By moving the guide projection 18 in the guide hole 32, a rotating motion of the lever 4 about the connector housing 9 is guided.

The lever support projection 14 penetrates into the operating point guide hole 31 and the guide projection 18 penetrates into the guide hole 32, so that the plate portion 29 is located between the inner housing 11 and the outer cover 12. Since the lever support projection 14 can move and rotate freely in the operating point guide hole 31, and the guide projection 18 can move in the guide hole 32, the plate portion 29 is mounted rotatably around the center on the connector housing 9.

The operating plate 30 is arranged in a position, in which the operating plate 30 can pile on the lever lock arm 16 when the plate portion 29 is located and rotated between the inner housing 11 and the outer cover 12. The operating plate 30 engages with the lever lock arm 16. By engaging the operating plate 30 with the lever lock arm 16, the operating plate 30 positions the lever 4 in a condition that the connectors 1, 3 are completely engaged.

The lever support projection 14 penetrates into the operating point guide hole 31, and the guide projection 18 penetrates into the guide hole 32, and the lever 4 is mounted on the connector 1 so as to space the inner housing 11. The lever 4 is supported rotatably about the center by the connector 1. When the connectors 1, 3 are engaged with each other, a later-described pivot boss 7 provided on the lever 4 penetrates into the pivot guide groove 6.

Figure 2:
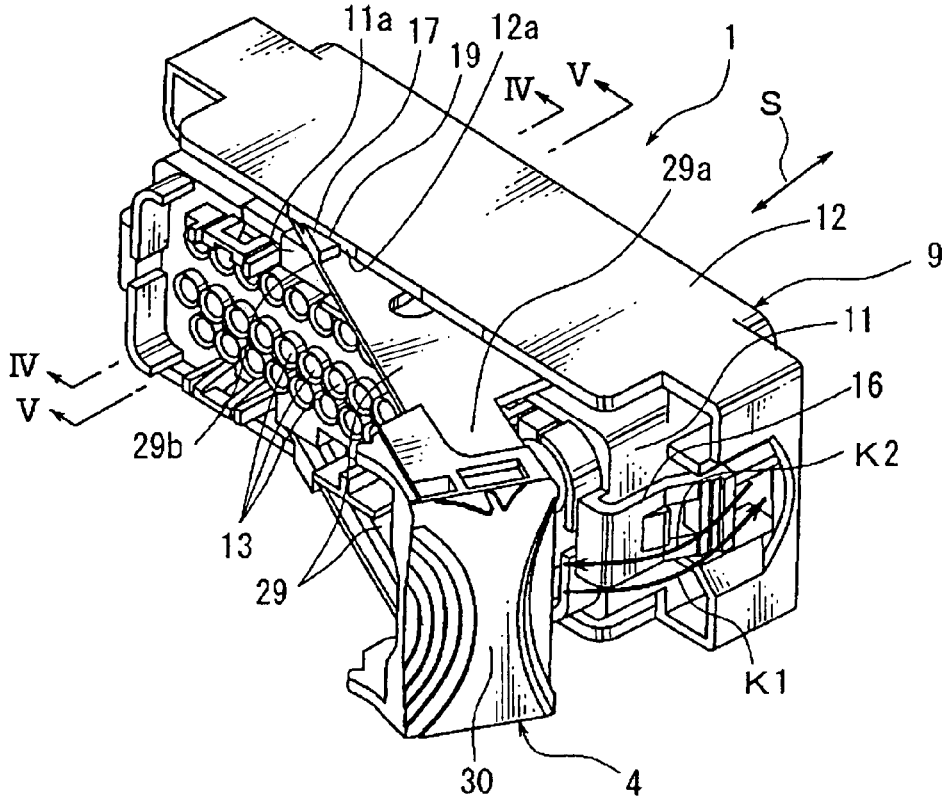
FIG. 2 is a perspective view of a connector assembled with a connector housing and a lever shown in FIG. 1.

The lever 4 rotates about the center along an arrow K1 shown in FIGS. 2, 3 against the connector housing 9 of the connector 1, and the pivot boss 7 slides (moves and rotates) in the pivot guide groove 6, and thereby, the connector 1, that is the connector housing 9, moves close to the mating connector 3, so that the connector housing 9, that is the connector 1, and the mating connector 3 are engaged. The arrow K1 corresponds to the one direction described in claims of the present invention.

The lever 4 rotates about the center along an arrow K2 opposite to the arrow K1 shown in FIGS. 2, 3 against the connector housing 9 of the connector 1, and the pivot boss 7 slides (moves and rotates) in the pivot guide groove 6, and thereby, the connector 1, that is the connector housing 9, moves apart from the mating connector 3, so that the connector housing 9, that is the connector 1, is disengaged from the mating connector 3. The arrow K2 corresponds to the other direction described in claims of the present invention.

Thus, the lever 4 rotates about the center along the arrows K1, K2 against the connector housing 9 of the connector 1, so that the lever 4 moves the mating connector 3 and the connector 1 close to and apart from each other. The rotation center of the lever 4 against the connector housing 9 is located in the vicinity of the operating point guide hole 31 (that is the center of the plate portion 29 of the lever 4).

Since the lock arm and the lock projection are disengaged completely, and the pivot boss 7 can freely penetrate into and move out from the pivot guide groove 6, the lever 4 is mounted rotatably about the connector 1 between a first position, in which the connectors 1, 3 are disengaged completely from each other (shown in FIGS. 2, 3) and a second position, in which the connectors 1, 3 are engaged completely by that the lock arm engages completely with the lock projection.

At the second position, most part of the plate portion 29 of the lever 4 is received between the outer cover 12 and the inner housing 11, and an outer edge 29*b*, at side far from the mating connector 3, of the plate portion 29 of the lever 4 projects from a gap between the outer cover 12 and the inner housing 11. At the first position, most part of the plate portion 29 (including the outer edge 29*b*) of the lever 4 projects from the gap between the outer cover 12 and the inner housing 11. When the lever 4 rotates along the arrow K2 from the second position toward the first position, the one end 29*a* of the plate portion 29 projects gradually toward the outside of the connector housing 9. When the lever 4 rotates furthermore along the arrow K2 from the first position, the one end 29*a* of the plate portion 29 tries to project more toward the outside of the connector housing 9.

The pivot boss 7 is provided at the other end 29*c* of a side opposite to the one end 29*a*, which is connected by the operating plate 30, of the lever 4. The pivot boss 7 is formed into a cylindrical shape and projects from the plate portion 29 toward another plate portion 29 of the pair of the plate portions 29. In other words, the pivot boss 7 is formed to project from the plate portion 29 toward the connector housing 22 of the mating connector 3 to engage with the connector 1. The other end 29*c* corresponds to the other end of the lever.

The limiter projection 17 is located in the vicinity of the operating point guide hole 31, that is the rotation center of the lever 4, and projects vertically from the outer edge 29*b* of the plate portion 29 of the lever 4 toward the connector housing 9, that is the outside of the connector 1. In short, the limiter boss 17 projects from the outer edge 29*b* of the plate portion 29 of the lever 4 toward the outer cover 12 of the connector housing 9.

Figure 4:
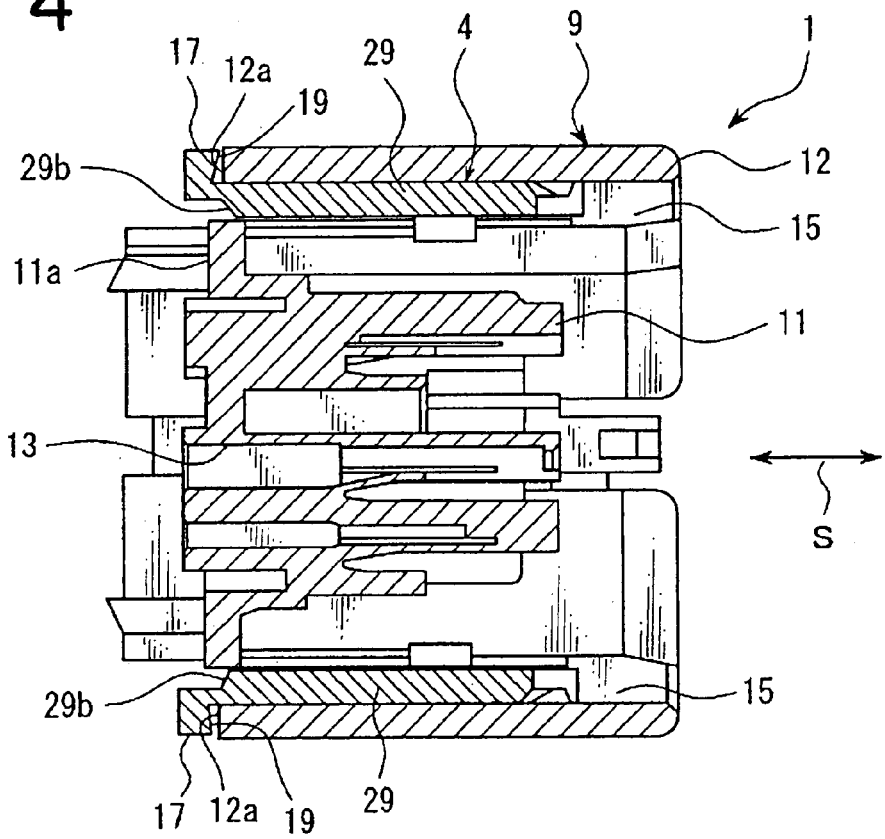
FIG. 4 is a cross-sectional view taken along the line IV-IV shown in FIG. 2.
Figure 5:
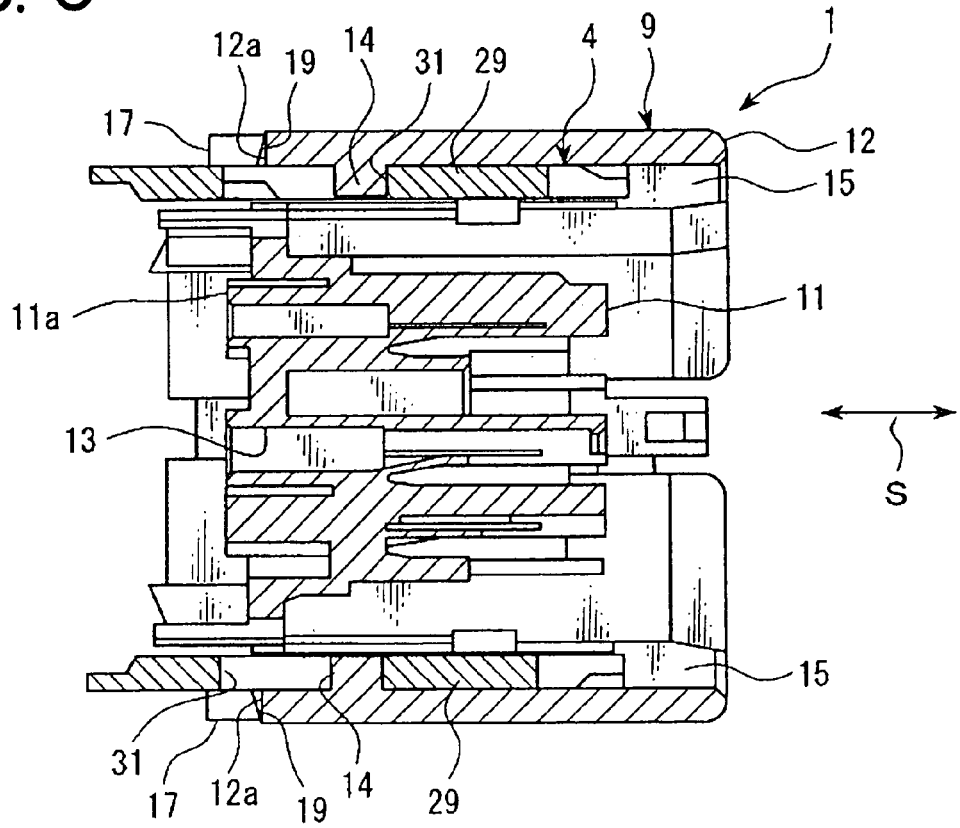
FIG. 5 is a cross-sectional view taken along the line V-V shown in FIG. 2.

When the lever 4 is positioned at the first position, the limiter projection 17 is exposed at the outside of the connector housing 9. The limiter projection 17 is located at a position nearer to the other end 29*c* of the plate portion 29 of the lever 4 than the operating point guide hole 32, that is the rotation center of the lever 4. When the lever 4 is positioned at the first position, that is, the connector housing 9 of the connector 1 is disengaged from the mating connector 3, the limiter projection 17 faces to an outer edge 12*a*, at a side far from the mating connector 3, of the outer cover 12 of the connector housing 9, as shown in FIGS. 4, 5. Thereafter, the limiter projection 17 abuts on the outer edge 12*a* of the outer cover 12 so as to limit the lever 4 to rotate further from the first position along the arrow K2.

The limiter projection 17 is provided with a slant surface 19 facing to the outer edge 12*a* of the outer cover 12, as shown in FIGS. 4, 5. When the lever 4 positioned at the first position rotates along the arrow K2, the slant surface 19 approaches the outer edge 12*a* of the outer cover 12, and abuts on the outer edge 12*a* of the outer cover 12. The slant surface 19 is slant to the engage/disengage direction S as connecting direction so as to be thinner gradually toward the outside of the connector housing 9 in accordance with approaching the outer edge 12*a* of the outer cover 12, as shown in FIGS. 1, 2.

Thereby, when the lever 4 positioned in the first position is rotated along the arrow K2, the slant surface 19 displaces the plate portion 29 of the lever 4 to approach the outer cover 12, and displaces the outer cover 12 to approach the plate portion 29 of the lever 4. Thus, the limiter projection 17 is provided with the slant surface 19 slant to the engage/disengage direction S so as to approach the outer cover 12 of the connector housing 9 and abut on the outer cover 12 for touching the lever 4 and the outer cover 12 of the connector housing 9 when the lever 4 rotates further from the condition of disengaging from the mating connector 3 along the arrow K2.

When the connector 1 and the mating connector 3 are engaged to each other, the female terminal joined with an electric wire is received in the connector housing 9, and the lever 4 is assembled in the connector housing 9 of the connector 1. In this condition, the lever 4 is positioned at the first position. By receiving the male terminal 25 in the connector housing 22, the mating connector 3 is assembled.

By inserting the pivot boss 7 through the opening at the other end into the pivot guide groove 6, and engaging temporarily the temporary engaging projection 23 and the lever lock arm 16 of the connector 1, the connectors 1, 3 are engaged temporarily. Thereby, the lever support projection 14 is positioned in an end portion, nearer to the operating plate 30, of the operating point guide hole 31, and the guide projection 18 is positioned in the guide hole 32. Then, the lever 4 is rotated along the arrow K1 toward the second position by pushing the operating plate 30 of the lever 4.

Thereby, the pivot boss 7 moves from the other end to the one end in the pivot guide groove 6 so as to move the connectors 1, 3 gradually close to each other. The lever support projection 14 moves from the end, nearer to the operating plate 30, to the end, farther from the operating plate 30, of the operating point guide hole 31, and the guide projection 18 moves in the guide hole 32.

Thereby, the lock projection and the lock arm are engaged to each other completely, and the connectors 1, 3 are connected. The operating plate 30 of the lever 4 is engaged with the lever lock arm 16, and the lever 4 is positioned at the second position. Thus, the connector 1 is connected with the mating connector 3.

For disengaging the connectors 1, 3, the lever 4 is rotated along the arrow K2 opposite to the previous direction from the second position toward the first position.

When the lever 4 is positioned at the first position, that is the connector housing 9 of the connector 1 is separated from the mating connector 3, by rotating the lever 4 along the arrow K2, the slant surface 19 of the limiter projection 17 abuts on the outer edge 12*a* of the outer cover 12. Thereby, the lever 4 is limited to rotate from the first position along the arrow K2, so that it is limited that the lever 4 falls away from the connector housing 9. Since the slant surface 19 is slant to the engage/disengage direction S, the outer cover 12 and the plate portion 29 of the lever 4 can touch more tightly.

In this embodiment, the limiter projection 17 for limiting rotation of the lever 4 is located in the vicinity of the rotation center of the lever 4, so that the limiter projection 17 is close to an operating point of the lever 4 (the operating plate 30). Thereby, when the lever 4 rotates further along the arrow K2 in a condition of separating from the mating connector 3, the force of the limiter projection 17 pushing the connector housing 9 is smaller than the force in case that the limiter projection 17 is located in the vicinity of a position farthest (the other end 29*c* of the plate portion 29) from the operating point of the lever 4 (the operating plate 30).

Therefore, when the lever 4 rotates further along the arrow K2 in the condition of disengaging from the mating connector 3, it can be prevented that the limiter projection 17 does not abut on the connector housing 9, and the outer cover 12 of the connector housing 9 rides on the limiter projection 17. Even if the lever 4 is pushed in the arrow K2 direction to separate from the mating connector 3 in the condition of disengaging from the mating connector 3, it can be prevented that the lever 4 falls away from the connector housing 9.

Since the limiter projection 17 is exposed at the outside of the connector housing 9 in the condition of disengaging from the mating connector 3, and located nearer to the other end 29*c* of the lever 4 than the rotation center, the limiter projection 17 approach the connector housing 9 even if the lever 4 rotates further along the arrow K2 in the condition of disengaging from the mating connector 3. Thereby, even if the lever 4 rotates further along the arrow K2 in the condition of disengaging from the mating connector 3, the limiter projection 17 abuts securely on the connector housing 9. It can be securely prevented that the lever 4 falls away from the connector housing 9.

Since the limiter projection 17 is arranged at the outer edge 29*b* of the plate portion 29 of the lever 4, the lever 4 has a simpler shape and a shape of a molding die for molding the lever 4 will become simpler. Thereby, a cost of the connector 1 can be reduced.

Since the limiter projection 17 is provided with the slant surface 19 to be slant for touching the lever 4 and the connector housing 9 tightly, even if the lever 4 rotates further along the arrow K2 in the condition of disengaging from the mating connector 3, the connector housing 9 and the lever 4 touch more tightly. Therefore, even if the lever 4 rotates further along the arrow K2 in the condition of disengaging from the mating connector 3, it can be more securely prevented that the lever 4 falls away from the connector housing 9.

Since the limiter projection 17 is exposed from the plate portion 29 of the lever 4 to the outside of the connector housing 9, and the slant surface 19 is slant so as to be thinner gradually toward the outside of the connector housing 9 in accordance with approaching the outer cover 12 of the connector housing 9, even if the lever 4 rotates further along the arrow K2 in the condition of disengaging from the mating connector 3, the outer cover 12 of the connector housing 9 and the lever 4 touch more tightly. Therefore, even if the lever 4 rotates further along the arrow K2 in the condition of disengaging from the mating connector 3, it can be more securely prevented that the lever 4 falls away from the connector housing 9.

In this embodiment, the pivot boss 7 projecting from the lever 4 is provided in the connector 1, and the pivot guide groove 6, in which the pivot boss 7 penetrates is provide in the mating connector 3. According the present invention, the pivot boss 7 can be provided in the mating connector 3, and the pivot guide groove 6, in which the pivot boss 7 penetrates can be provide in the connector 1.

Figure 6:
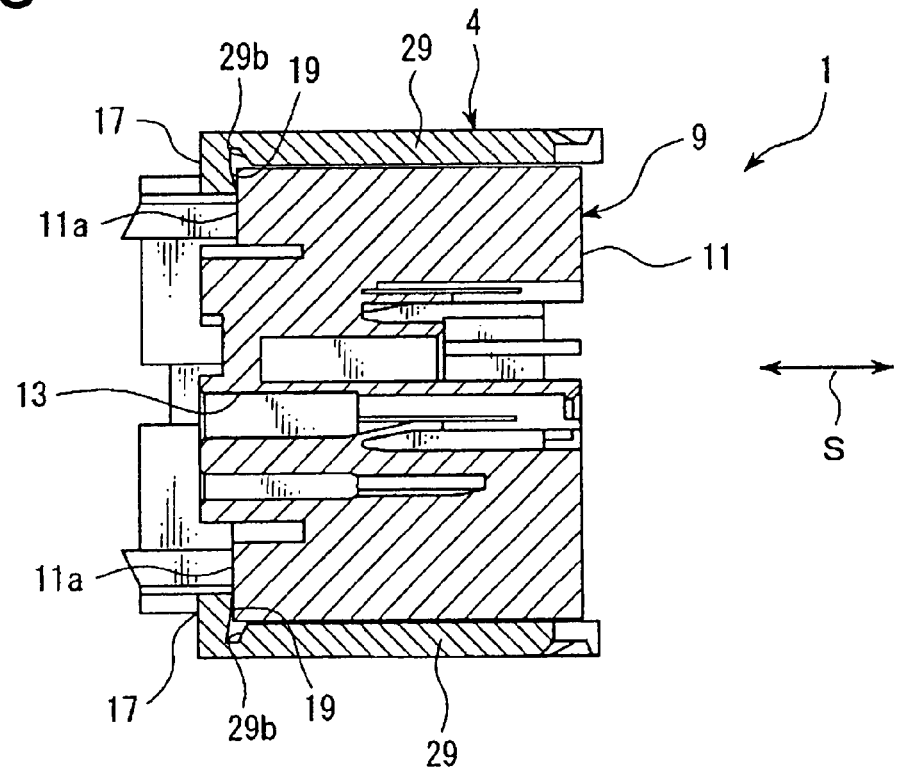
FIG. 6 is a cross-sectional view of a modification of the connector shown in FIG. 4.
Figure 7:
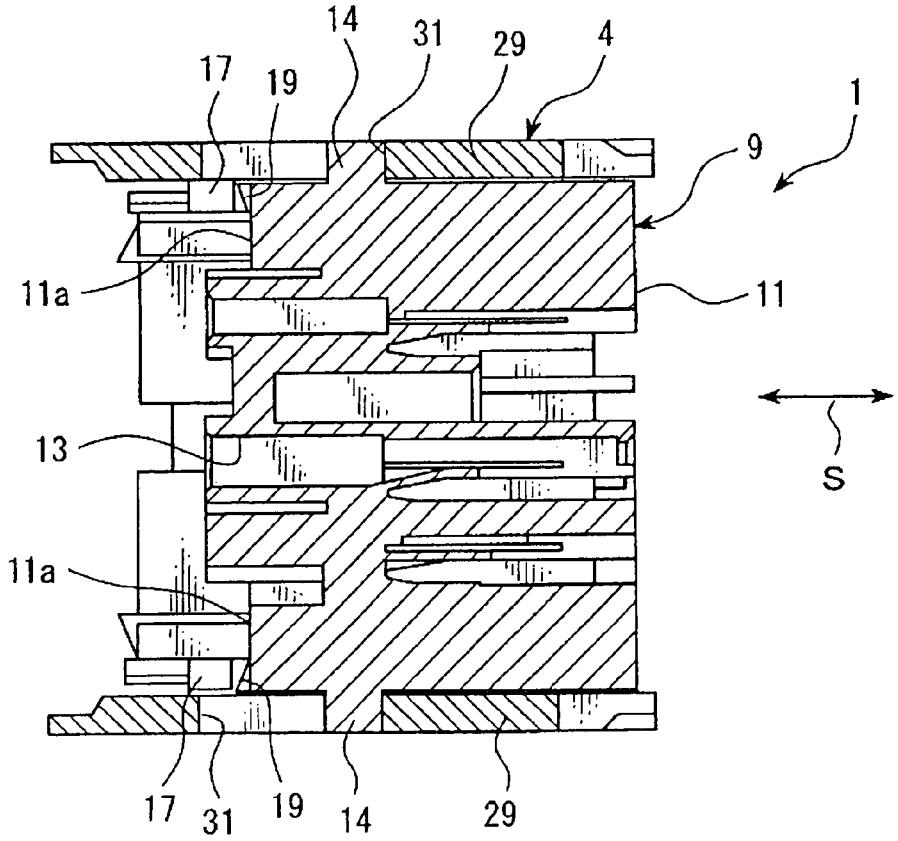
FIG. 7 is a cross-sectional view of a modification of the connector shown in FIG. 5.

According to the present invention, the connector housing 9 of the connector 1 can have no the outer cover 12, but only the inner housing 11, as shown in FIGS. 6, 7. In FIGS. 6, 7, the same components as that in the above embodiment are put with the same mark and description about them is omitted. In this case, the lever support projection 14 is provided projectingly from the outer surface of the inner housing 11, and the pivot boss 7 is formed projectingly (to stand) from the plate portion of the lever 4 in a direction apart from another plate portion 29 of the pair of the plate portions 29. The pivot guide groove 6 is formed by recessing from the inner surface of the connector housing 22 of the mating connector 3.

In the case shown in FIGS. 6, 7, the plate portion 29 of the lever 4 is piled on the outer surface of the inner housing 11. The limiter projection 17 is formed (vertically) to project from the outer edge 29*b* of the plate portion 29 of the lever 4 toward the inside of the connector housing 9, that is toward the inner housing 11 of the connector housing 9. The limiter projection 17 is provided with the slant surface 19 to correspond to an outer edge 11*a*, at a side far from the mating connector 3, of the inner housing 11 of the connector housing 9.

When the lever 4 rotates further along the arrow K2 in the condition of disengaging from the mating connector 3, the slant surface 19 approaches the outer edge 11*a* of the inner housing 11 and abuts on the outer edge 11*a* of the inner housing 11. The slant surface 19 is slant to the engage/disengage direction S so as to approach gradually toward the inside of the connector housing 9, that is the inner housing 11, in accordance with approaching the outer edge 11*a* of the inner housing 11.

Thereby, when the lever 4 positioned in the first position is rotated along the arrow K2, the slant surface 19 displaces the plate portion 29 of the lever 4 to approach the inner housing 11, and displaces the inner housing 11 to approach the plate portion 29 of the lever 4. Thus, the limiter projection 17 is provided with the slant surface 19 slant to the engage/disengage direction S so as to approach the inner housing 11 of the connector housing 9 and abut on the inner housing 11 for touching the lever 4 and the inner housing 11 of the connector housing 9 when the lever 4 rotates further from the condition of disengaging from the mating connector 3 along the arrow K2.

In FIGS. 6, 7, since the limiter projection 17 projects from the lever 4 to the inside of the connector housing 9, and the slant surface 19 is slant so as to be gradually toward the inside of the connector housing 9 in accordance with approaching the inner housing 11 of the connector housing 9, even if the lever 4 rotates further along the arrow K2 in the condition of disengaging from the mating connector 3, the inner housing 11 of the connector housing 9 and the lever 4 touch more tightly. Therefore, even if the lever 4 rotates further along the arrow K2 in the condition of disengaging from the mating connector 3, it can be more securely prevented that the lever 4 falls away from the connector housing 9.

According to the present invention, the limiter projection 17 can be located at any other suitable position other than the other end 29*c* of the lever 4. In the above embodiment, the connector 1 is defined as a male connector, but can be defined as a female connector.

While, in the embodiment, an only typical example of the present invention is described, it is not limited thereto. Various change and modifications can be made with the scope of the present invention.

What is claimed is:

1. A connector assembly comprising:

a connector and a mating connector;

a connector housing;

a lever, having an operating end for operating the lever and a far end, the lever being mounted rotatably at a central portion thereof on the connector housing, the lever rotating in an engaging direction so as to engage the connector housing with the mating connector by moving the connector housing close to the mating connector, and said lever rotating in a disengaging direction, opposite to the engaging direction, so as to disengage the connector housing from the mating connector by moving the connector housing apart from the mating connector; and a limiter provided on the lever for limiting the lever not to rotate further in the disengaging direction from a disengaged condition in which the connector housing is disengaged from the mating connector, wherein the limiter is provided on the lever to project from the lever to face the connector housing and is provided on the lever in a vicinity of a rotation center of the lever when the lever rotates about the connector housing;

wherein one end of the lever displaces toward the connector housing when the lever rotates further in the disengaging direction from the disengaged condition, and wherein the limiter is arranged at a position on the lever nearer to the far end of the lever opposite and space from the operating end;

wherein the limiter is arranged at an outer edge of the lever to face the connector housing in the disengaged condition.

2. The connector assembly according to claim 1, wherein the limiter is provided with a slant surface slanted to an engaging direction of engaging the connector housing with the mating connector, the slant surface being arranged to abut on the connector housing for causing the lever and the connector housing to contact tightly when rotating the lever further in the disengaging direction when in the disengaged condition.

3. The connector assembly according to claim 2, wherein the connector housing comprises a main body for receiving a terminal and for piling the lever on an outer surface of the main body, wherein the limiter projects from the lever toward the connector housing, and the slant surface is slanted to the engaging direction to direct gradually the connector housing when the slant surface engages the main body, for causing the lever and the main body to contact tightly when rotating the lever further in the disengaging direction from the disengaged condition.

4. The connector assembly according to claim 1, wherein the connector housing comprises a main body for receiving a terminal and for piling the lever on an outer surface of the main body, wherein the limiter projects from the lever toward the connector housing, and the slant surface is slanted to the engaging direction to direct gradually the connector housing when the slant surface engages the main body, for causing the lever and the main body to contact tightly when rotating the lever further in the disengaging direction from the disengaged condition.

5. A connector assembly comprising:

a connector and a mating connector;

a connector housing;

a lever, having an operating end for operating the lever and a far end, the lever being mounted rotatably at a central portion thereof on the connector housing, the lever rotating in an engaging direction so as to engage the connector housing with the mating connector by moving the connector housing close to the mating connector, and said lever rotating in a disengaging direction, opposite to the engaging direction, so as to disengage the connector housing from the mating connector by moving the connector housing apart from the mating connector; and a limiter provided on the lever for limiting the lever not to rotate further in the disengaging direction from a disengaged condition in which the connector housing is disengaged from the mating connector, wherein the limiter is provided on the lever to project from the lever to face the connector housing and is positoned near a far end on an outer edge of the lever, opposite and space from the operating end in a vicinity of a rotation center of the lever when the lever rotates about the connector housing, the limiter is provided with a slant surface slanted to an engaging direction of engaging the connector housing with the mating connector, the slant surface being arranged to abut on the connector housing for causing the lever and the connector housing to contact tightly when rotating the lever further in the disengaging direction when in the disengaged condition, and the connector housing comprises a main body for receiving a terminal and a hood spaced apart from the main body for positioning the lever between the main body and the hood, wherein the limiter projects from the lever to face the connector housing, and the slant surface is slanted to the engaging direction to direct gradually the connector housing when the slant surface engages the hood, for causing the lever and the hood to contact tightly when rotating the lever further in the disengaging direction from the disengaged condition.

6. A connector assembly comprising:

a connector and a mating connector;

a connector housing;

a lever, having an operating end for operating the lever and a far end, the lever being mounted rotatably at a central portion thereof on the connector housing, the lever rotating in an engaging direction so as to engage the connector housing with the mating connector by moving the connector housing close to the mating connector, and said lever rotating in a disengaging direction, opposite to the engaging direction, so as to disengage the connector housing from the mating connector by moving the connector housing apart from the mating connector; and a limiter provided on the lever for limiting the lever not to rotate further in the disengaging direction from a disengaged condition in which the connector housing is disengaged from the mating connector, wherein the limiter is provided on the lever to project from the lever to face the connector housing and is positioned near a far end on an outer edge of the lever, opposite and space from the operating end in a vicinity of a rotation center of the lever when the lever rotates about the connector housing, one end of the lever displaces toward the connector housing when the lever rotates further in the disengaging direction from the disengaged condition, the limiter is arranged at a position on the lever nearer to the far end of the lever than the rotation center, the limiter is provided with a slant surface slanted to an engaging direction of engaging the connector housing with the mating connector, the slant surface being arranged to abut on the connector housing for causing the lever and the connector housing to contact tightly when rotating the lever further in the disengaging direction when in the disengaged condition, and the connector housing comprises a main body for receiving a terminal and a hood spaced apart from the main body for positioning the lever between the main body and the hood, wherein the limiter projects from the lever to face the connector housing, and the slant surface is slanted to the engaging direction to direct gradually the connector housing when the slant surface engages the hood, for causing the lever and the hood to contact tightly when rotating the lever further in the disengaging direction from the disengaged condition.

7. A connector assembly comprising:

a connector and a mating connector;

a connector housing;

a lever, having an operating end for operating the lever and a far end, the lever being mounted rotatably at a central portion thereof on the connector housing, the lever rotating in an engaging direction so as to engage the connector housing with the mating connector by moving the connector housing close to the mating connector, and said lever rotating in a disengaging direction, opposite to the engaging direction, so as to disengage the connector housing from the mating connector by moving the connector housing apart from the mating connector; and a limiter provided on the lever for limiting the lever not to rotate further in the disengaging direction from a disengaged condition in which the connector housing is disengaged from the mating connector, wherein the limiter is provided on the lever to project from the lever to face the connector housing and is provided on the lever in a vicinity of a rotation center of the lever when the lever rotates about the connector housing, one end of the lever displaces toward the connector housing when the lever rotates further in the disengaging direction from the disengaged condition, the limiter is arranged at a position on the lever nearer to the far end of the lever opposite and space from the operating end, the limiter is arranged at an outer edge of the lever to face the connector housing in the disengaged condition, the limiter is provided with a slant surface slanted to an engaging direction of engaging the connector housing with the mating connector, the slant surface being arranged to abut on the connector housing for causing the lever and the connector housing to contact tightly when rotating the lever further in the disengaging direction when in the disengaged condition, and the connector housing comprises a main body for receiving a terminal and a hood spaced apart from the main body for positioning the lever between the main body and the hood, wherein the limiter projects from the lever to face the connector housing, and the slant surface is slanted to the engaging direction to direct gradually the connector housing when the slant surface engages the hood, for causing the lever and the hood to contact tightly when rotating the lever further in the disengaging direction from the disengaged condition.

* * * * *